US006244777B1

(12) United States Patent
Reid

(10) Patent No.: US 6,244,777 B1
(45) Date of Patent: Jun. 12, 2001

(54) ONE-USE TOOTHBRUSH ASSEMBLY WITH EXTERNAL PLUG FOR RELEASING TOOTHPASTE FROM THE INTERIOR, AND METHOD FOR USING THE SAME

(75) Inventor: David R. Reid, Vancouver, WA (US)

(73) Assignee: The Global Corporation, Vancouver, WA (US)

( * ) Notice: Subject to any disclaimer, the term of this patent is extended or adjusted under 35 U.S.C. 154(b) by 0 days.

(21) Appl. No.: 09/670,311

(22) Filed: Sep. 26, 2000

Related U.S. Application Data

(63) Continuation-in-part of application No. 09/338,846, filed on Jun. 23, 1999, now abandoned.

(51) Int. Cl.[7] ..... A46B 17/04

(52) U.S. Cl. ..... 401/269; 401/282; 401/176; 401/180

(58) Field of Search ..... 401/269, 282, 401/286, 288, 176, 180

(56) References Cited

U.S. PATENT DOCUMENTS

| | | | |
|---|---|---|---|
| 1,033,743 | 7/1912 | Smiddy . | |
| 1,279,507 | 9/1918 | Briggs . | |
| 1,325,268 | 12/1919 | Sosdian . | |
| 2,305,158 | 12/1942 | Hanses | 221/102 |
| 2,416,684 | 3/1947 | Fischer | 15/138 |
| 2,517,806 | 8/1950 | Streiler | 132/91 |
| 2,652,949 | 9/1953 | Martin | 222/95 |
| 2,665,442 | 1/1954 | Martino | 15/137 |
| 2,908,924 | 10/1959 | Turman | 15/137 |
| 3,853,134 | 12/1974 | McCord | 132/92 |
| 4,004,597 | 1/1977 | Kupperman et al. | 132/84 |
| 4,294,269 | 10/1981 | Kyte | 132/84 B |
| 4,467,822 | 8/1984 | Blackwell | 132/84 B |
| 4,615,635 | 10/1986 | Kim | 401/270 |
| 4,673,106 | 6/1987 | Fishman | 222/80 |
| 4,693,622 | 9/1987 | Booth | 401/191 |
| 4,787,765 | 11/1988 | Kuo | 401/191 |
| 4,865,481 | 9/1989 | Scales | 401/195 |
| 4,919,156 | 4/1990 | Gipson | 132/309 |
| 4,922,935 | 5/1990 | Birkeland | 132/309 |
| 4,950,095 | 8/1990 | Picard | 401/191 |
| 4,957,125 | 9/1990 | Yaneza | 132/309 |
| 4,987,910 | 1/1991 | Lowe | 132/309 |
| 5,097,852 | 3/1992 | Wu | 132/309 |
| 5,346,324 * | 9/1994 | Kuo | 401/288 |
| 5,348,028 | 9/1994 | Gustavel | 132/309 |
| 5,827,001 | 10/1998 | Taghavi-Khanghah | 401/145 |
| 5,832,940 | 11/1998 | Embry et al. | 132/309 |

* cited by examiner

*Primary Examiner*—David J. Walczak
(74) *Attorney, Agent, or Firm*—Marger Johnson & McCollom; Gregory T. Kavounas

(57) ABSTRACT

A disposable toothbrush assembly has a special hollow handle that contains enough toothpaste for one use. The handle includes a dispensing orifice, preferably at the head. An external plug seals the orifice, and thus also the toothpaste from the exterior. The plug is manually removable to unseal the orifice. A compressed spring within the handle can be released by removing a stop. This causes a piston at the end of the spring to eject the toothpaste through the dispensing orifice on the bristles. The stop is advantageously formed integrally with the plug.

9 Claims, 2 Drawing Sheets

ONE-USE TOOTHBRUSH ASSEMBLY WITH EXTERNAL PLUG FOR RELEASING TOOTHPASTE FROM THE INTERIOR, AND METHOD FOR USING THE SAME

CROSS REFERENCE TO RELATED APPLICATIONS

This application is a Continuation-In-Part from U.S.A. Non-Provisional Patent Application Serial No. 09/338,846, filed on Jun. 23, 1999, now abandoned.

BACKGROUND OF THE INVENTION

1. Field of the Invention

The present invention is related to the field of toothbrushes, and more specifically to a disposable toothbrush assembly that delivers toothpaste stored in the handle.

2. Description of the Related Art

Toothbrushes for brushing one's teeth are well known. It is also known to store toothpaste within the handle of a toothbrush for multiple uses. For example, U.S. Pat. No. 1,325,268 to Sosdian discloses a toothbrush that stores toothpaste in the handle. A dispensing mechanism, that maintains a plug within the handle, dispenses toothpaste on the bristles.

A problem in such prior art devices is in making the dispensing mechanism. The art has consistently used a plug to seal the toothpaste, as it might become stale. Such plugs have been made internal to the handle which makes the handle large, and the dispensing mechanism elaborate and thus not economical to manufacture.

BRIEF SUMMARY OF THE INVENTION

The present invention overcomes these problems and limitations of the prior art.

Generally, the present invention provides a disposable toothbrush assembly. It includes a special hollow handle that contains enough toothpaste for one use. The handle includes a dispensing orifice, preferably at the head. An external plug seals the orifice, and thus also the toothpaste from the exterior. The plug is manually removable to unseal the orifice. A dispensing action ejects the stored toothpaste out through the dispensing orifice for brushing.

DETAILED DESCRIPTION OF THE PREFERRED EMBODIMENT(S)

As has been mentioned, the present invention provides a one-use, disposable toothbrush assembly. The preferred embodiment is now described with reference to FIGS. 1–3.

Figure 1:
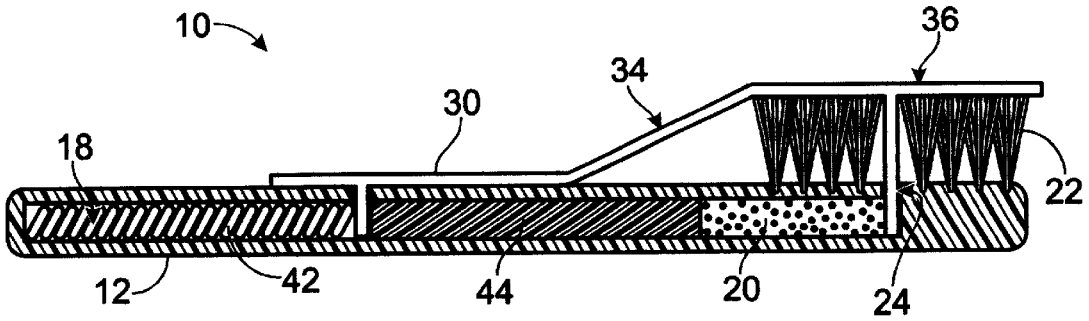
FIG. 1 is a section diagram of a toothbrush assembly made according to the invention, prior to use.

Referring to FIG. 1, a toothbrush assembly 10 made according to the invention has an elongate handle 12. The handle is hollow, in that it includes a cavity 18. Toothpaste 20 is stored in the cavity 18.

An important aspect of this invention is that the toothbrush is intended to be disposable, i.e. of one use. This means that preferably, although not necessarily, there is enough toothpaste for just one tooth brushing session. After use, the toothbrush can be discarded, which solves the problem of storing it after use.

An advantage of the one-use feature is that very little toothpaste need be stored, contrary to what is taught in the prior art. Indeed, for the embodiment of FIG. 1, detailed dimensions can be as follows. The handle apart from the bristles can be a tube that is 0.370" in diameter, and with a wall 0.060" thick. Therefore, the volume of the cavity can be as little as about 0.1 inches cubed. The invention can be well accomplished where the cavity has a volume of less than 0.2 inches cubed. As such, the whole toothbrush can become very small. For example, the length can be 3.50", and the bristles can occupy 0.75" of this length. This is much smaller than what the prior art envisions as useful, and diminishes storage problems before use.

Toothbrush 10 also includes bristles 22 that are used for brushing the teeth. They can be made small, commensurately with the handle 12, although that is not necessary.

The handle 12 is considered to have a general exterior surface. Such is recited to avoid confusion with any interior surfaces of the handle 12.

The handle 12 includes a hole 24 through the exterior surface, which is also called dispensing orifice 24. More formally, orifice 24 is located such that it permits the cavity 18 to communicate with a location at an exterior of the handle 12.

Orifice 24 is preferably and advantageously located near the bristles 22. In the most preferred embodiment, orifice 24 is surrounded by bristles 22. As will be appreciated from FIG. 3, the toothpaste 20 will be ejected from cavity 18, through orifice 24, and find itself on bristles 22. This will facilitate brushing the teeth.

The toothbrush furthermore includes a special cap 30. The cap 30 includes a plug 32, which can be inserted in the dispensing orifice 24, to seal the toothpaste 20 in it. Insertion is from outside the handle 12, which simplifies the design of the handle. Preferably, the plug 32 is oblong. It has a main direction substantially parallel to a direction of the bristles 22, which may optionally be oblong.

The cap 30 additionally includes a grasping portion 34, for manually grasping the cap. Once grasped from the grasping portion 34, the cap 30 can be pulled away from the handle 12. This also pulls plug 32 out of the dispensing orifice 24, which unseals it.

Optionally and preferably the cap 30 includes a flat area 36. Area 36 is for shielding tips of the bristles 22, when the plug 32 seals the dispensing orifice 24.

The main advantage of including flat area 36 is that it minimizes the need to include instructions for usage. Indeed, the user will see that, in an otherwise ordinary looking toothbrush, the flat area 36 is obstructing access to the very bristles 22. So, the user will recognize a need to remove it, without looking for instructions.

In the most preferred embodiment, the flat area 36 is preferably made of transparent material. This is to permit to user to see the bristles 22 through the flat area 36, even if she first picks up the toothbrush assembly 10 with the flat area 36 directly in front of the bristles 22.

The whole cap 30 is preferably made out as a single piece. One useful material is plastic, which is further transparent for the reason mentioned above.

The cap 30 may or may not be attached to the handle 12. It may or may not be formed integrally with it.

There are a number of ways of ejecting the toothpaste from the cavity 18 according to the invention. The preferred such way is described in this document by way of illustration. This is not limiting, however. Other ways of driving the toothpaste out of the handle 12 can be used for implementing the invention.

In the preferred embodiment, the toothbrush assembly 10 includes a spring 42. Spring 42 is provided within the handle 12, in cavity 18. In addition, a piston 44 is provided adjacent spring 42.

Figure 2:
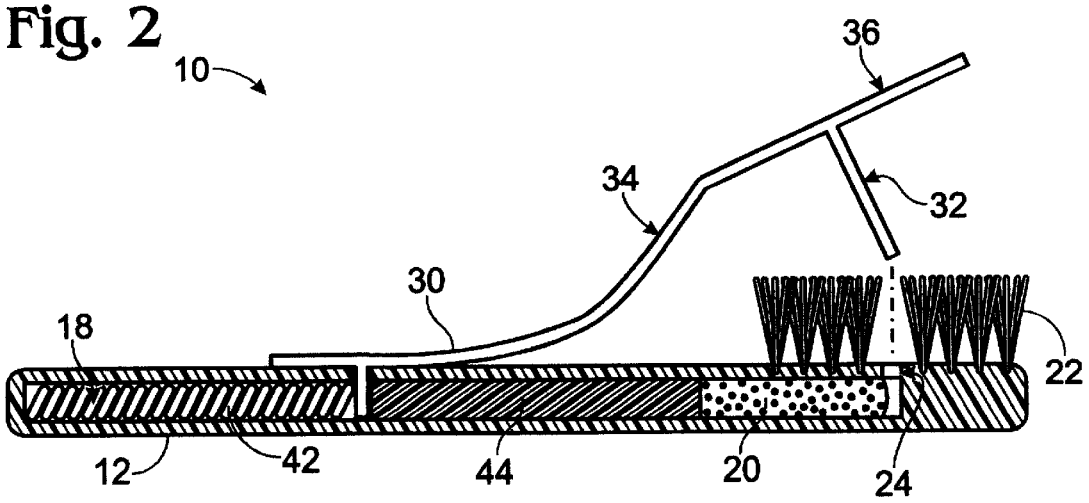
FIG. 2 is a section diagram of the toothbrush of FIG. 1, after the external plug has been pulled to unseal the dispensing orifice.
Figure 3:
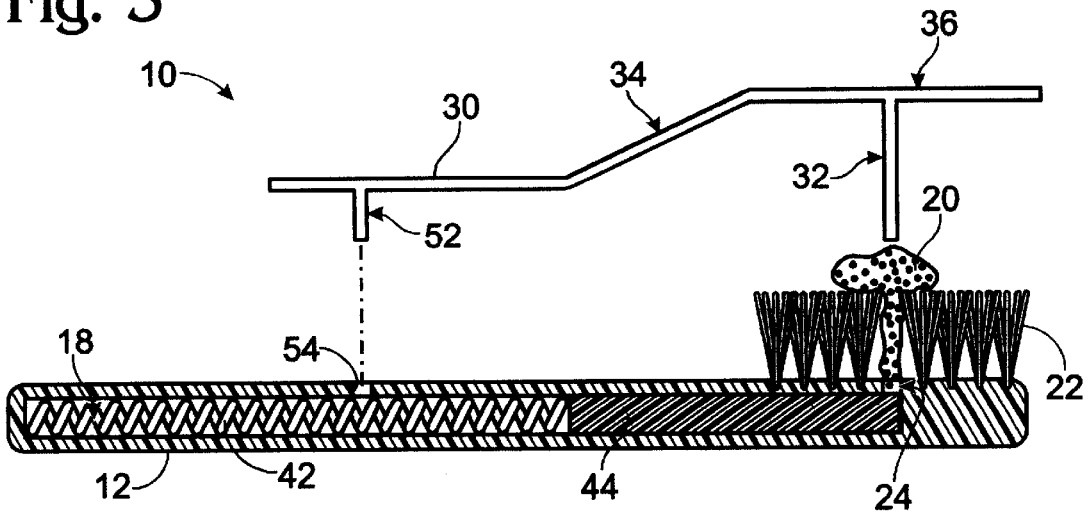
FIG. 3 is a section diagram of the toothbrush of FIG. 2, after a stop has been pulled to release a spring, which ejects the toothpaste.

As seen in FIG. 1 and FIG. 2, spring 42 is provided compressed. The spring 42 is provided for ejecting, via piston 44, the toothpaste 20 when it is released.

The invention further includes a release mechanism for releasing the spring 42. The preferred release mechanism is an oblong stop 52. Once stop 52 is pulled, spring 42 is released, and pushes piston 44 to the end of cavity 18. This ejects all the toothpaste 20 out of the cavity 18.

In the most preferred embodiment, the stop 52 is provided integrally with cap 30. This minimizes the number of parts. As seen from FIG. 2 and FIG. 3, once the cap 30 has been pulled far enough away to remove plug 32 from orifice 24, it can be further pulled farther away, so that stop 52 can be pulled out of a hole 54 in the handle 12. This releases the spring 42.

As will be obvious to a person skilled in the art, a toothbrush made according to the invention can incorporate any one or more of the features described and/or claimed. Only the preferred embodiment was given, for the sake of brevity. A person skilled in the art will be able to practice the present invention in view of the present description, where numerous details have been set forth in order to provide a more thorough understanding of the invention. In other instances, well-known features have not been described in detail in order not to obscure unnecessarily the invention.

Figure 4:
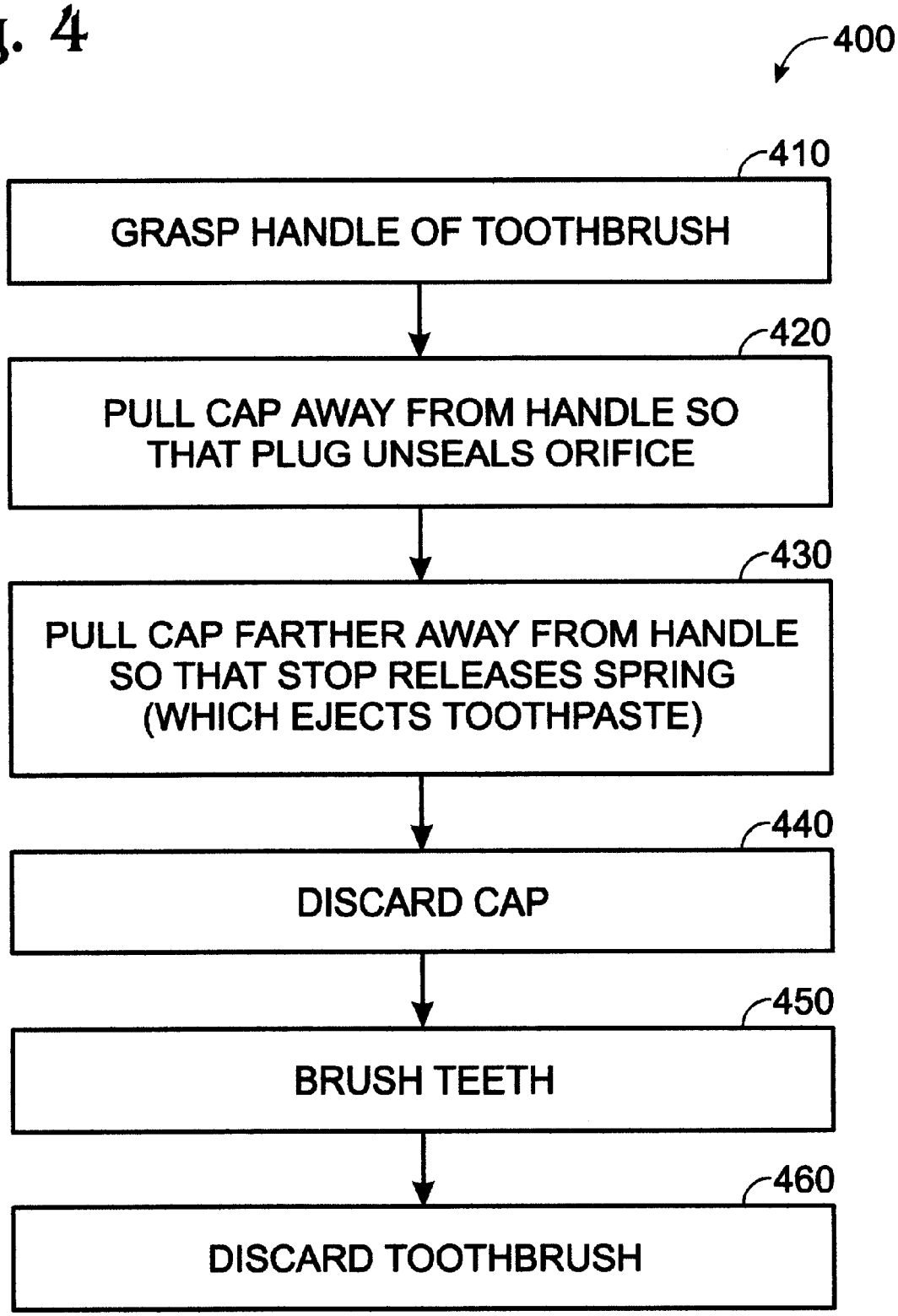
FIG. 4 is a flowchart illustrating a method according to the invention.

A method of the invention is now described with reference to flowchart 400 in FIG. 4 . The methods are for using a toothbrush for brushing teeth.

According to a first step 410 of the invention, a handle of the toothbrush assembly is grasped.

According to a next step 420, a cap of the toothbrush assembly is pulled away from the handle. This causes a plug of the cap to unseal a dispensing orifice in an exterior surface of the handle.

According to a next step 430, the toothpaste is driven through the cavity towards the dispensing orifice, and out of the handle through the orifice. In the preferred embodiment, this is accomplished by further pulling the cap farther away from the handle. This causes a stop of the cap to releases a spring within the handle. Releasing the spring causes toothpaste stored within the handle to be ejected through the dispensing orifice to the exterior of the handle. It is preferred to perform this while holding the toothbrush with the bristles up! .

According to an optional next step 440, the cap is discarded, while retaining the handle for the subsequent brushing of the teeth. This only takes place if the cap is not formed integrally with the handle, or attached to it. If they are, then it is moved aside, to permit brushing.

According to a next box 450, the user brushes the teeth with the ejected toothpaste, and also by holding the handle.

According to a next step 460, the toothbrush and any remaining toothpaste are discarded.

Having illustrated and described the principles of the invention in a preferred embodiment thereof, it should be readily apparent to those skilled in the art that the invention can be modified in arrangement and detail without departing from such principles. All modifications coming within the spirit and scope of the accompanying claims are claimed as follows.

The invention claimed is:

1. A toothbrush assembly comprising:

a handle having an exterior surface and a dispensing orifice through the exterior surface;

toothpaste stored within the handle, and which can be ejected to an exterior of the handle through the dispensing orifice, when the dispensing orifice is unsealed;

a spring within the handle for ejecting the toothpaste when released; and a cap including a plug that can be inserted in the dispensing orifice to seal it from outside the handle, the cap additionally including a grasping portion for manually grasping the cap, wherein when the cap is grasped and pulled away from the handle, the plug is pulled out of the dispensing orifice to unseal it, the cap further including a stop for maintaining the spring compressed within the handle, and wherein the cap can be pulled by the grasping portion for pulling the stop to release the spring.

2. The toothbrush assembly of claim 1, further comprising:

bristles attached to the handle, and surrounding the dispensing orifice, wherein the plug is oblong, and has a main direction substantially parallel to a direction of the bristles.

3. The toothbrush assembly of claim 1, wherein:

the cap includes a flat area for shielding tips of the bristles when the plug seals the dispensing orifice.

4. The toothbrush assembly of claim 3, wherein the flat area is made from transparent material.

5. The toothbrush assembly of claim 1, wherein:

the cap is separable from the handle.

6. The toothbrush assembly of claim 1, wherein:

the cap is attached to the handle.

7. A method of using a toothbrush assembly for brushing teeth, comprising:

grasping a handle of the toothbrush assembly;

pulling a cap of the toothbrush assembly away from the handle so that a plug of the cap unseals a dispensing orifice in an exterior surface of the handle;

further pulling the cap farther away from the handle so that a stop of the cap releases a spring within the handle;

ejecting toothpaste stored within the handle through the dispensing orifice to an exterior of the handle; and brushing the teeth with the ejected toothpaste.

8. The method of claim 7, further comprising:

discarding the cap while retaining the handle for the brushing of the teeth.

9. The method of claim 7, wherein releasing the spring ejects the toothpaste.

* * * * *